US005388544A

United States Patent [19]

Kobayashi

[11] Patent Number: 5,388,544

[45] Date of Patent: Feb. 14, 1995

[54] FUEL SYSTEM FOR DOCKING WATERCRAFT

[75] Inventor: Noboru Kobayashi, Iwata, Japan

[73] Assignee: Yamaha Hatsudoki Kabushiki Kaisha, Iwata, Japan

[21] Appl. No.: 158,899

[22] Filed: Nov. 29, 1993

[30] Foreign Application Priority Data

Nov. 27, 1992 [JP] Japan ..... 4-318782

[51] Int. Cl.[6] ..... B63B 21/56

[52] U.S. Cl. ..... 114/248; 440/88

[58] Field of Search ..... 114/343, 248, 256; 440/88

[56] References Cited

U.S. PATENT DOCUMENTS 3,659,546 5/1972 Miklos ..... 114/248

3,815,541 6/1974 Hansen ..... 114/248

FOREIGN PATENT DOCUMENTS 465996 1/1992 European Pat. Off. ..... 114/248

*Primary Examiner*—Stephen P. Avila

*Attorney, Agent, or Firm*—Knobbe, Martens, Olson & Bear

[57] ABSTRACT

A watercraft for extending the utility of a small personal watercraft designed to accommodate only one or two riders. The watercraft is comprised of a main hull that is devoid of any propulsion device and which defines a berthing area into which the smaller watercraft may be driven. The berthing area and the smaller watercraft are designed so that the propulsion device of the smaller watercraft may power the main hull when it is in the berthing area. A fuel supply system is provided in the main hull for transferring fuel to the smaller watercraft to extend the range of the combined watercraft.

11 Claims, 5 Drawing Sheets

FUEL SYSTEM FOR DOCKING WATERCRAFT

BACKGROUND OF THE INVENTION

This invention relates to a docking type of watercraft and more particularly to an improved fuel system for such watercraft.

There is a very popular type of small watercraft that is designed to be operated primarily by a rider with the possibility of one passenger seated behind him in straddle tandem fashion. This type of watercraft is very sporting in nature. However, this type of watercraft's capability of carrying passengers is limited and its range is also limited in view of its relatively small size.

It has been proposed to improve the utility of such watercraft by mating it with a larger watercraft which is basically unpowered but which has a docking or berthing area into which the smaller watercraft may be manipulated in the body of water. The smaller watercraft that can then be used as a propulsion device for the larger watercraft.

A number of embodiments of such types of watercraft are shown in the copending application filed in the name of the inventor, Toshiyuki Hattori, entitled "Watercraft," U.S. Ser. No. 07/722,599, filed Jun. 27, 1991 and assigned to the assignee hereof. That application shows a number of embodiments wherein the larger unpowered hull may provide various seating arrangements so that the smaller watercraft can operate and carry a larger number of passengers. The berthing and seating arrangements for the larger unpowered hull is such that an operator may operate the combined watercraft from either within the larger hull or while riding on the smaller watercraft in the berthing area. This type of watercraft greatly enhances the utility of the smaller personal watercraft and thus enhances the desirability of owning such smaller watercraft.

However, the smaller watercraft, as previously noted, is designed to have a relatively small range because of its very nature. In addition, the compact size does not afford large fuel capacity. However, when powering a larger unpowered hull, the fuel consumption can rise significantly. As a result, the type of watercraft shown in the aforenoted copending application still has limited range, and in fact, less range than the smaller watercraft alone.

It is, therefore, a principal object of this invention to provide an improvement in this docking type of watercraft.

It is a further object of this invention to provide an improved docking type of watercraft wherein the larger unpowered hull carries a fuel supply for the smaller powering watercraft.

It is a further object of this invention to provide an improved fuel system for a watercraft of this type that facilitates the transfer of fuel from the larger unpowered hull into the smaller powering watercraft.

SUMMARY OF THE INVENTION

This invention is adapted to be embodied in a watercraft comprised of a main hull defining a passenger's compartment and a berthing area open through the main hull and adapted to receive a smaller watercraft having a propulsion device including an internal combustion engine. The main hull is devoid of any propulsion device and the berthing area is configured so that the propulsion device of the smaller watercraft may be employed to power the main hull through a body of water. A fuel tank is provided in the main hull and means are provided for delivering fuel from the fuel tank to the smaller watercraft engine for its consumption.

BREIF DESCRIPTION OF THE DRAWINGS

DETAILED DESCRIPTION OF THE PREFERRED EMBODIMENT OF THE INVENTION

Figure 1:
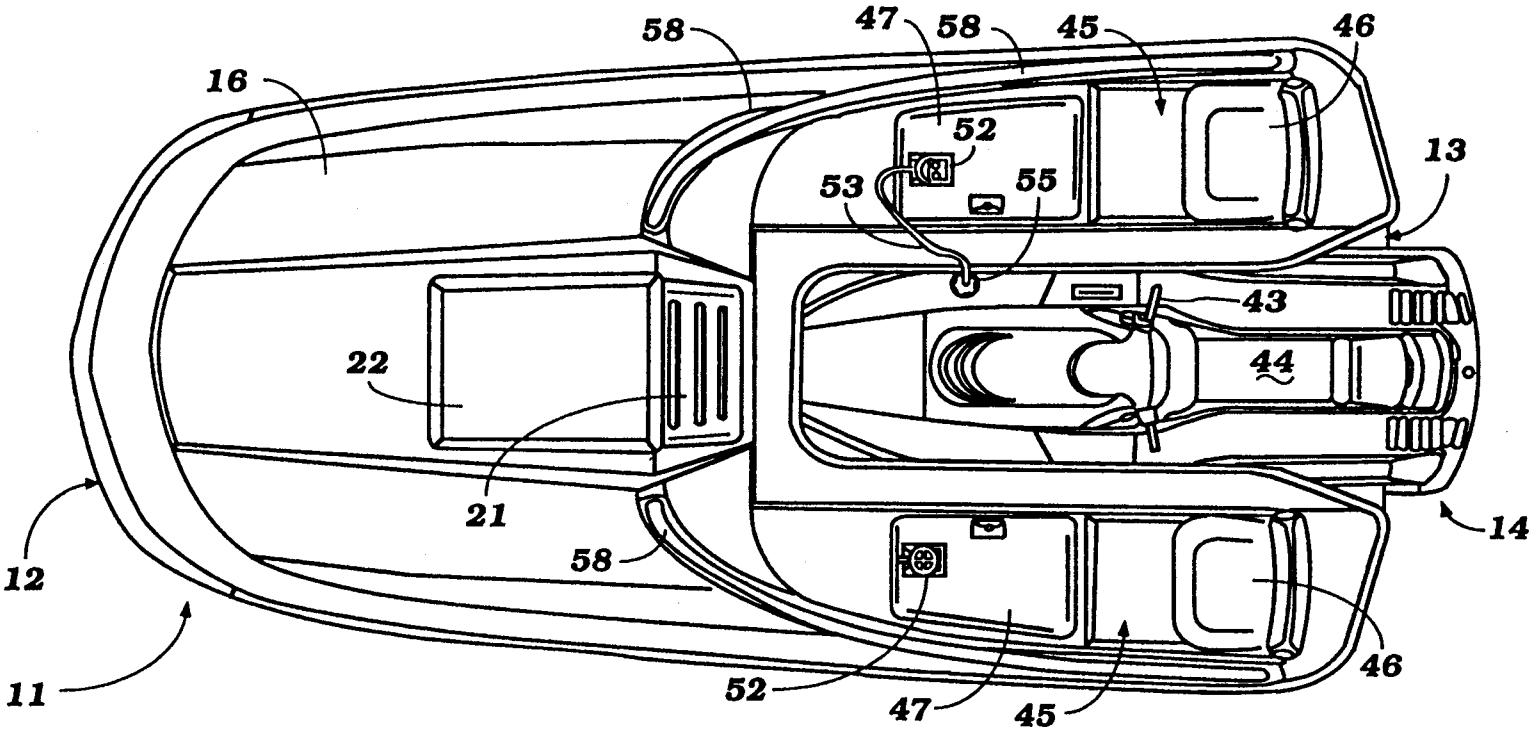
FIG. 1 is a top plan view of docking type watercraft constructed in accordance with an embodiment of the invention.
Figure 2:
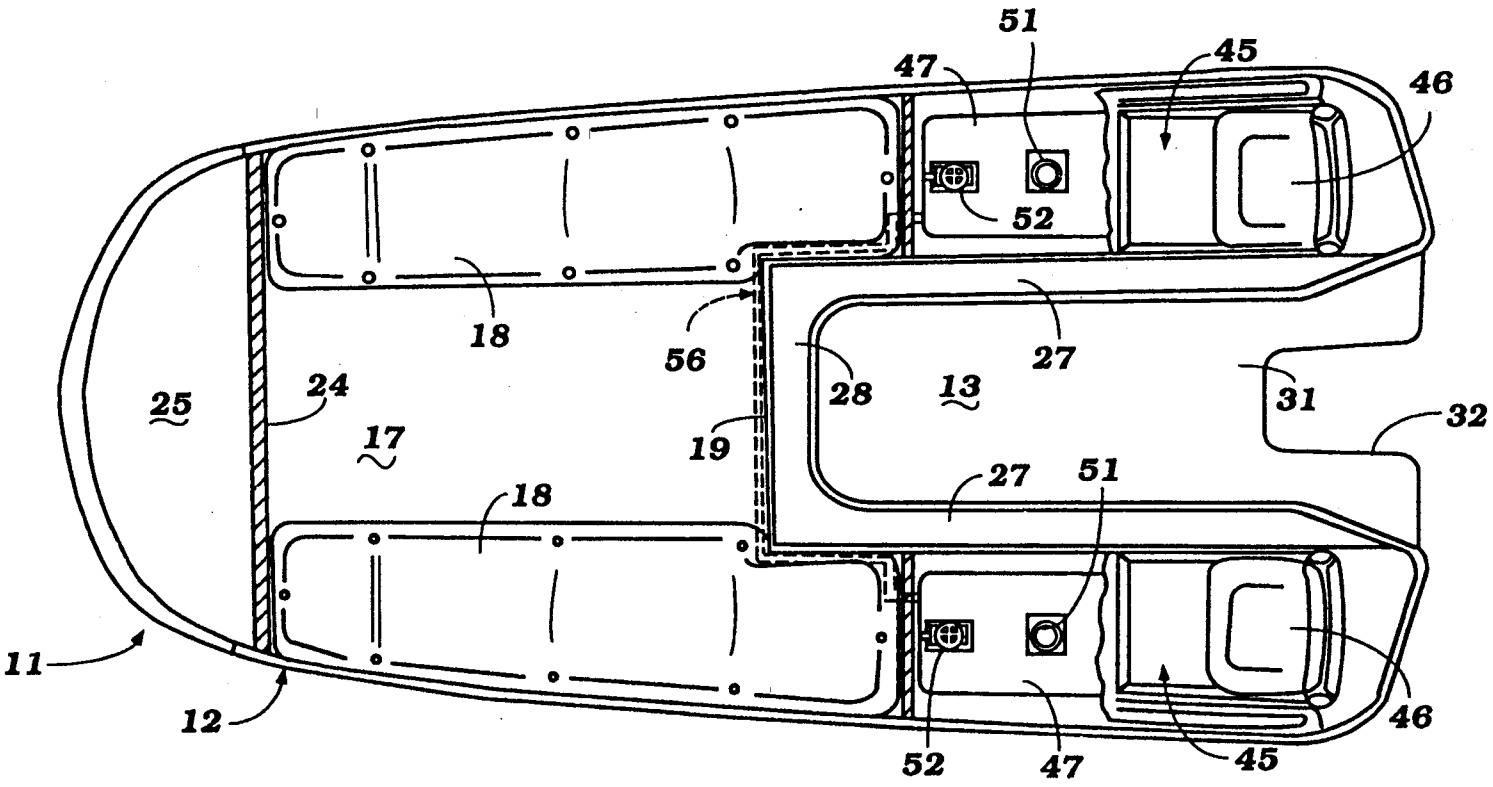
FIG. 2 is a cross-sectional view taken through the watercraft of FIG. 1 at a point above its lower portion.
Figure 5:
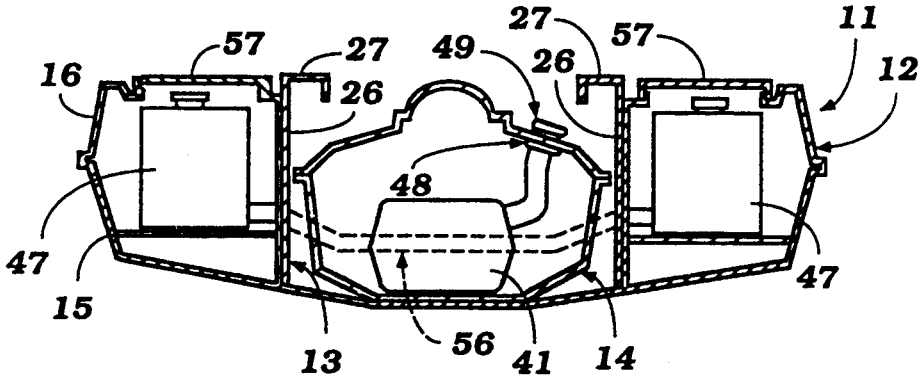
FIG. 5 is a transverse cross-sectional view taken through the berthing area in the area immediately to the rear of the main hull fuel tanks.

Referring now in detail to the drawings, a docking or berthing type of watercraft constructed in accordance with an embodiment of the invention as identified generally by the reference numeral 11. The watercraft 11 is actually designed to be a composite watercraft consisting of a main unpowered hull, indicated generally by the reference numeral 12 and which has a berthing area, indicated generally by the reference numeral 13, that is adapted to receive a smaller powered watercraft, indicated generally by the reference numeral 14. As will become apparent, the main hull 12 rides in the water in such a way that the smaller watercraft 14 may be powered into the berthing area 13 into a position as shown in solid lines in FIGS. 1 and 5 and in phantom lines in FIG. 3. In this condition, the smaller watercraft 14 may be used to propel the combined watercraft 11.

The main hull 12 is comprised of a lower hull portion 15 and an upper deck portion 16 with the portions 15 and 16 being formed from any suitable material such as a molded fiberglass reinforced resin or the like.

Forwardly of the berthing area 13, the hull and deck portions 15 and 16 define a cabin area 17 which is formed with a pair of side-by-side bunks 18 which either can accommodate occupants lying or seated. These bunks 18 extend in part back beyond the center of a rear bulkhead 19 and along the sides of the berthing area 13. The cabin 17 is accessible through a pair of hatch covers 21 and 22. The forward end of the cabin 17 is defined by a bulkhead 24 which defines a void area 25 that may be filled with a flotation material, if desired.

Referring now to the berthing area, it is bounded at the front by the bulkhead 19 and on the sides by means of a pair of side walls 26 (FIG. 5) that have inwardly extending flanges 27 at their upper end so as to partially overlie the berthing area. In addition, a similar flange 28 is formed at the rear portion of the bulkhead 19. The berthing area 13 is open through the transom of the hull 12 so as to facilitate entry and exit of the smaller watercraft 14.

A docking assemblage 29 is mounted on the side of the bulkhead 19 facing the berthing area 13 and is adapted to nestingly receive the bow of the smaller watercraft 114. In addition, the berthing area is defined by a lower wall 31 which extends towards the rear of the hull 12 and then is interrupted by a cutout 32, for a reason now to be described.

Figure 3:
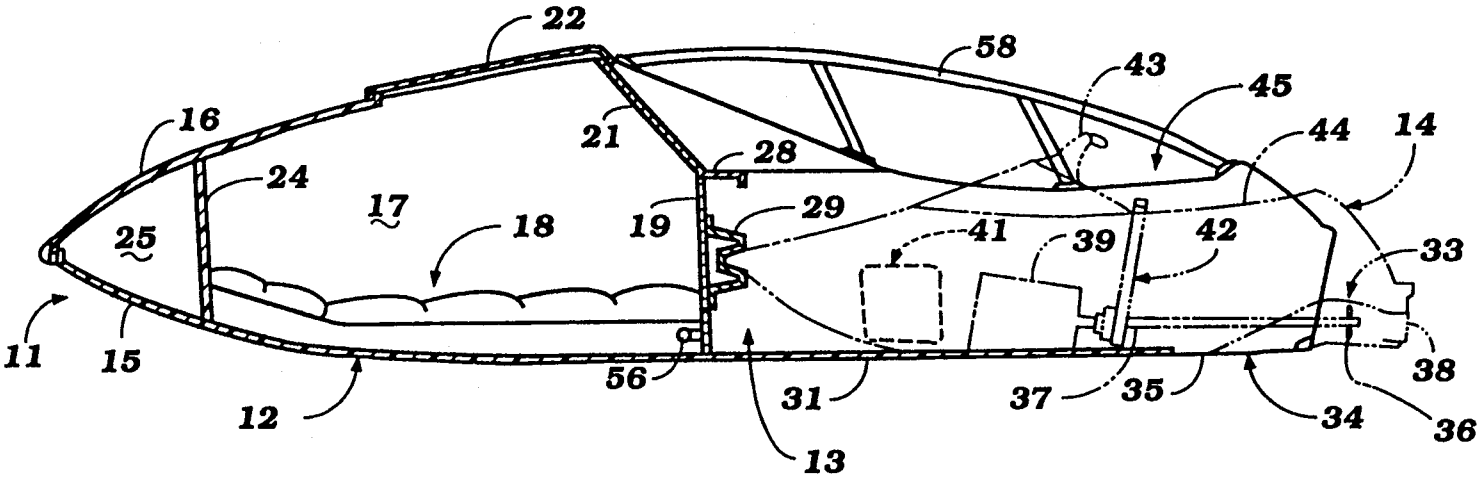
FIG. 3 is a longitudinal cross-sectional view taken through the center of the watercraft and shows the smaller watercraft in the berthing area in phantom line.
Figure 4:
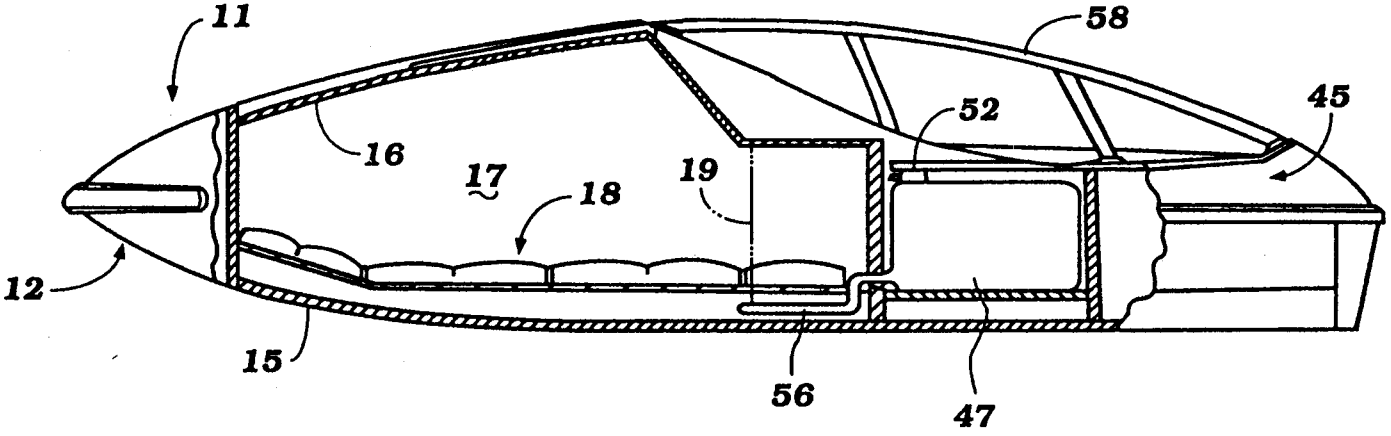
FIG. 4 is a longitudinal cross-sectional view, in part similar to FIG. 3, and is taken along one side of the berthing area.

The smaller watercraft 14 may be of any general configuration but is of the type that is powered by a jet propulsion unit, shown in phantom in FIG. 3 and identified generally by the reference numeral 33. This jet propulsion unit 33 has a downwardly facing water inlet opening 34 formed in its undersurface 35 and which is designed so as to be positioned within the slot 32 in the lower wall 31 of the main hull 12 when the smaller watercraft 14 is received therein. This permits the jet propulsion unit 33 to be employed for powering the combined watercraft 11 when the smaller watercraft 14 is in the berthing area 13.

An impeller 36 is affixed to an impeller shaft 37 within the jet propulsion unit 33 and draws water through the inlet 34 and discharges it rearwardly through a discharge nozzle 38 which may include a steering nozzle, as is well known in this art.

An internal combustion engine 39 is positioned within the hull of the smaller watercraft 14 and is coupled to the impeller shaft 37 for driving the impeller 36 in a well known manner. A relatively small fuel tank 41 is positioned in the forward portion of the hull of the main watercraft 14 and supplies fuel to the engine 39 for its operation.

In order to improve the efficiency of the jet propulsion unit 33 when it is powering the combined watercraft 11, there is provided a hold down strap assembly, indicated generally by the reference numeral 42 in FIG. 3 and which goes across the rider's seat of the small watercraft 14 so as to hold the lower hull surface 35 of the smaller watercraft into engagement with the lower wall 31 of the berthing area. This improves the efficiency of the operation of the jet propulsion unit 33 of the smaller watercraft when it is in the berthing area.

It should be noted that the smaller watercraft 14 is controlled by a handlebar assembly 43 and this handlebar assembly is positioned forwardly of its seat 44 for operation by a rider seated upon the seat 44. In addition, a throttle control is carried by the handlebar assembly 43.

A pair of rider's compartments 45 are disposed in the main unpowered hull 12 on opposite sides of the berthing area 13 and each contain a seat 46 so as to afford seating for a pair of passengers. These seats 46 are disposed in such proximity to the handlebar assembly 43 that the small watercraft 14 and the attached main hull 12 may be operated by a person sitting in either of these seats 46. Alternatively, a rider may sit on the seat 44 of the small watercraft 14 for operating the combined watercraft. Hence, it should be apparent that there is in fact a passenger's compartment that extends substantially around the entire periphery of the berthing area 13 comprised of the forward cabin 17 and the two side seating areas 45.

The fuel tank 41 of the smaller watercraft 14 generally is designed so as to carry an adequate amount of fuel for propelling the smaller watercraft. Of course, this amount of fuel will not be adequate to permit the combined watercraft to be driven long distances, as may be desirable. In addition, when the two watercraft are coupled together, the fuel consumption will, obviously, increase. Therefore, the area between the passenger's seating area 45 and the cabin 17 on opposite sides of the berthing area 13 are provided with relatively stationarily installed fuel tanks 47. It should be noted from FIG. 5 that the fuel tanks 47 are actually positioned at a slightly higher level than the fuel tank 41 of the smaller watercraft 14. As will become apparent, this permits ease of transfer of fuel from the larger storage tanks 47 to the smaller tank 41 of the small watercraft 14.

Figure 6:
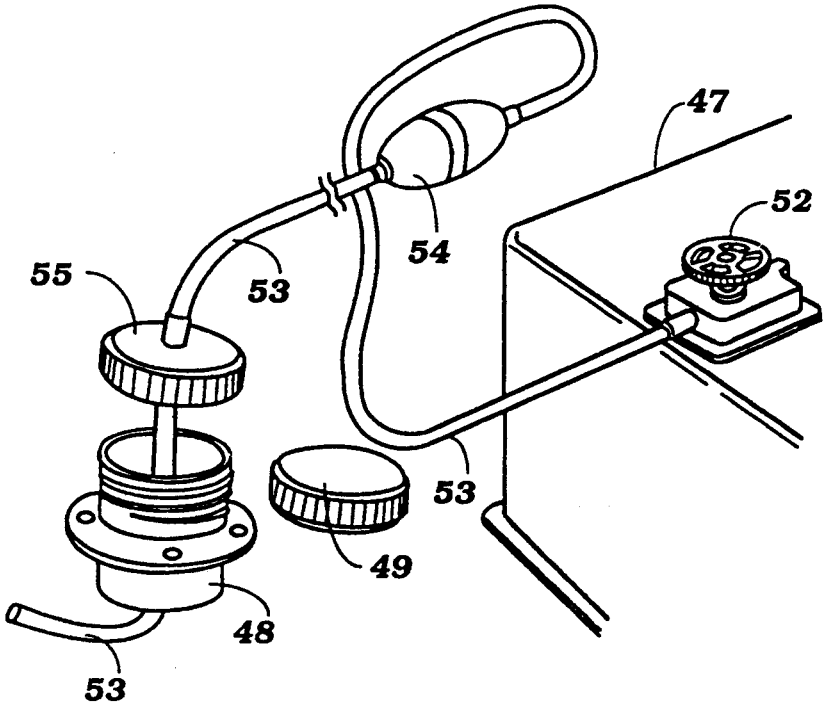
FIG. 6 is an exploded view showing the fuel transfer system from the main hull to the small watercraft when positioned in the berthing area.

The small watercraft 14, as is typical has a fill neck 48 (FIGS. 5 and 6) which extends through the upper portion of its deck immediately forward and to one side of the handlebar assembly 43. A fuel cap 49 normally closes this fill neck 48. The larger main fuel tanks 47 each have their own respective fill necks 51 and, in addition, have selector valves 52 either of which may be connected to a conduit 53 having a bulb-type priming pump 54 in it. The conduit 53 extends through a further screw cap 55 with the conduit 53 extending downwardly so that when the cap 55 is screwed on the fill neck 48 after removing the cap 49, fuel may be readily transferred from either tank 47 to the fuel tank 41 of the small watercraft 14. In addition, a side-to-side connector pipe 56 extends between the tanks 47 through the front of the bulkhead 19 so that draining fuel from one tank 47 will also drain fuel from the tank at the other side.

Once the fuel transfer has been completed, either the cap 54 and conduit 53 can be disconnected and the cap 49 of the small watercraft 14 returned. Alternatively, the conduit 53 may be left in place and fuel may continue to be supplied from the larger storage tanks 47 to the small watercraft tank 41 during operation.

Cover plates 57 are provided to cover the area forwardly of the seating areas 45 and the fuel tanks 47.

A rail assembly 58 extends from the hatch covers 21 and 22 along the sides of the seating areas 45 so as facilitate maneuvering within the watercraft and offer some degree of safety.

It should be readily apparent from the foregoing description that the described construction provides a very effective larger unpowered watercraft that can be easily propelled by the small watercraft 14 and which may be operated over large distances even though the small watercraft 14 has a relatively small fuel capacity due to the provision of additional fuel in the unpowered main hull 12. Of course, the foregoing description is that of a preferred embodiment of the invention and various changes and modifications may be made without departing from the spirit and scope of the invention, as defined by the appended claims.

What is claimed is:

1. A watercraft comprised of a main hull defining a passenger's compartment and a berthing area open through said main hull and adapted to receive a smaller watercraft having a propulsion device including an internal combustion engine, said main hull being devoid of any propulsion device, said berthing area being configured so that said propulsion device of said smaller watercraft may be employed to power said main hull through a body of water, a pair of fuel tanks in said main hull disposed on opposite sides of said berthing area, conduit means extending across said main hull at one end of said berthing area for interconnecting said fuel tanks, and means for delivering fuel form said fuel tanks to said smaller watercraft internal combustion engine for its operation.

2. The watercraft as set forth in claim 1, wherein the smaller watercraft has a fuel tank and the means for conveying fuel conveys fuel from the main hull fuel tanks to the smaller watercraft fuel tank.

3. The watercraft as set forth in claim 2, wherein the smaller watercraft fuel tank is disposed lower than the fuel tanks of the main hull when the smaller watercraft is in the berthing area.

4. The watercraft as set for in claim 1, wherein the berthing area opens through the transom of the main hull so that the smaller watercraft can move longitudinally into the berthing area and the conduit means is positioned forward of the berthing area.

5. The watercraft as set forth in claim 4, further including a control device for controlling the smaller watercraft and wherein the passenger's compartment is disposed contiguous to the control device when the smaller watercraft is in the berthing area for operating said control device from said passenger's compartment of said main hull.

6. The watercraft as set forth in claim 5, wherein the passenger's compartment includes at least one seat on the side of the berthing area in proximity to the small watercraft control.

7. The watercraft as set forth in claim 6, wherein the smaller watercraft has a fuel tank and the means for conveying fuel conveys fuel from the main hull fuel tanks to the smaller watercraft fuel tank.

8. The watercraft as set forth in claim 4, wherein the passenger's compartment comprises a pair of seating areas disposed on opposite sides of the berthing area and a cabin disposed forwardly of the berthing area.

9. The watercraft comprised of a main hull defining a passenger's compartment and a berthing area open through the transom of said main hull and adapted to receive a smaller watercraft having a propulsion device including an internal combustion engine, said main null being devoid of any propulsion device, said berthing area being configured so that said propulsion device of said smaller watercraft may be employed to power said main hull through a body of water, a fuel tank in said main hull, and means for delivering fuel from said fuel tank to said smaller watercraft internal combustion engine for its operation, said passenger's compartment comprising a pair of seating areas disposed on opposite sides of said berthing area and a cabin disposed forwardly of the berthing area; and a pair of bunks in said cabin extending along the sides of said main hull and in part along the sides of said berthing area.

10. The watercraft as set forth in claim 9, further including a control device for controlling the smaller watercraft and wherein the passenger's compartment is disposed contiguous to the control device when the smaller watercraft is in the berthing area for operating said control device from said passenger's compartment of said main hull.

11. The watercraft as set forth in claim 10, wherein the passenger's compartment includes at least one seat on the side of the berthing area in proximity to the small watercraft control.

* * * * *